United States Patent [19]

Jones, Jr.

[11] 4,218,985

[45] Aug. 26, 1980

[54] STEERING AND STABILIZATION APPARATUS FOR TORPEDO

[76] Inventor: Allen Jones, Jr., 5028 Lauderdale Ave., Virginia Beach, Va. 23455

[21] Appl. No.: 4,718

[22] Filed: Jan. 19, 1979

Related U.S. Application Data

[60] Division of Ser. No. 822,227, Aug. 5, 1977, Pat. No. 4,135,687, which is a continuation-in-part of Ser. No. 661,626, Feb. 26, 1976, Pat. No. 4,040,373, which is a continuation-in-part of Ser. No. 579,896, May 22, 1975, abandoned, which is a continuation-in-part of Ser. No. 566,353, Apr. 9, 1975, Pat. No. 3,995,575, which is a continuation-in-part of Ser. No. 279,714, Aug. 10, 1972, Pat. No. 3,881,438.

[51] Int. Cl.[3] ..... F42B 19/01

[52] U.S. Cl. ..... 114/23; 114/152; 114/282

[58] Field of Search ..... 114/23, 25, 20, 21 R, 114/280, 126, 283, 152, 281, 282; 244/3.24, 3.27, 3.29

[56] References Cited

U.S. PATENT DOCUMENTS

| | | | |
|---|---|---|---|
| 1,401,628 | 12/1921 | Meitner | 114/23 |
| 3,415,467 | 12/1968 | Barringer | 244/3.29 |
| 3,608,509 | 9/1971 | Brooks et al. | 114/20 R X |
| 3,896,755 | 7/1975 | Marburg | 114/126 |
| 3,996,872 | 12/1976 | Pinchott | 114/280 |
| 4,040,373 | 8/1977 | Jones | 114/280 X |

*Primary Examiner*—David H. Brown

[57] ABSTRACT

A torpedo operable submerged in water is provided with a pair of vane members mounted on opposite sides of the body thereof in recesses provided therefor. Each vane member includes a mounting section disposed in a recess and a long outwardly flared section; each of such vane members being rotatable about an operationally horizontal common axis passing through the mounting section thereof. Such vane members are selectively rotatable about such common axis into and out of alignment with the flowstream moving rearwardly alongside the body of such torpedo as the same moves forwardly through the water to concurrently serve steering and heeling functions or to serve a pitching function.

4 Claims, 3 Drawing Figures

STEERING AND STABILIZATION APPARATUS FOR TORPEDO

The present application is a division of application Ser. No. 822,227, filed Aug. 5, 1977, now U.S. Pat. No. 4,135,687 dated Jan. 23, 1979, which is a continuation-in-part of application Ser. No. 661,626, filed Feb. 26, 1976, now U.S. Pat. No. 4,040,373, issued Aug. 9, 1977, which was a continuation-in-part of application Ser. No. 579,896, filed May 22, 1975, now abandoned, which was a continuation-in-part of application Ser. No. 566,353, filed Apr. 9, 1975, now U.S. Pat. No. 3,995,575, issued Dec. 7, 1976, which in turn was a continuation-in-part of application Ser. No. 279,714, filed Aug. 10, 1972, now U.S. Pat. No. 3,881,438, issued May 6, 1975.

The present invention relates to steering and stabilization apparatus for naval torpedos operable completely submerged in water.

Heretofore, torpedos usually have been launched to run at a predetermined depth in a straight line on a collision course with a target vessel such as a moving ship. Such torpedos are often observed by those aboard such a target vessel, who then initiate evasive maneuvers to cause such torpedos to miss such target vessel. The present application, accordingly, is drawn to the provision of a maneuverable torpedo which may be guided towards such a target vessel notwithstanding any such evasive maneuvers thereof; such torpedo carrying steering and stabilizing apparatus operable to coordinate concurrent turning and heeling functions thereof for facilitating stable steering maneuvers.

Accordingly, it is an object of the present invention to provide a novel and improved steering and stabilizing apparatus for torpedos operable submerged in water.

Another object of the instant invention is the provision of torpedos operable submerged in water with improved steering, stabilization, and heel control apparatus.

According to the present invention, the foregoing and other objects are attained by providing a pair of vane members rotatably mounted on opposite sides of the body of a torpedo operable submerged in water. Such vane members are mounted in recesses formed in the sides of the body of such torpedo to occupy sheltered positions in which they lie completely within the overall cross-sectional outline of the body of such torpedo, permitting the same to be stored in a launch tube carried by a ship or an aircraft having a tubular interior similar in outline, taken in cross-section, to such overall cross-sectional outline of the body of such torpedo. Each of such vane members includes a mounting section extending along a substantially planar, substantially operationally vertically extending portion of the surface of such torpedo body recess in which each of such vane members are mounted, and each of such vane members are mounted to rotate about an operationally substantially horizontally disposed axis extending such mounting section of each of the same. Each of such vane members also includes at least a gradually curving long outwardly flared section.

Such vane members are rotatable about such axis from the sheltered position thereof to an operating position with the outwardly flared section of each of the same operationally projecting more or less vertically upwardly, for example. While in their operating positions, such vane members are counter-rotatable to selectively expose their upper or lower surfaces to the flowstream moving rearwardly alongside the body of the torpedo carrying the same as it moves forwardly through the water to concurrently serve steering and heeling functions. While in their operating positions, such vane members are rotatable in unison in the same direction to serve a pitching function and thereby raise or lower such torpedo carrying the same in the water.

A torpedo provided with vane members according to the present invention may also be provided with hydrofoil means similarly occupying a sheltered position within the overall cross-sectional outline of such torpedo also rotatable into an extended operating position.

A more complete appreciation of the invention and many of the attendant advantages thereof will be readily apparent as the same becomes better understood by reference to the following detailed description when considered in connection with the accompanying drawing wherein.

Figure 1:
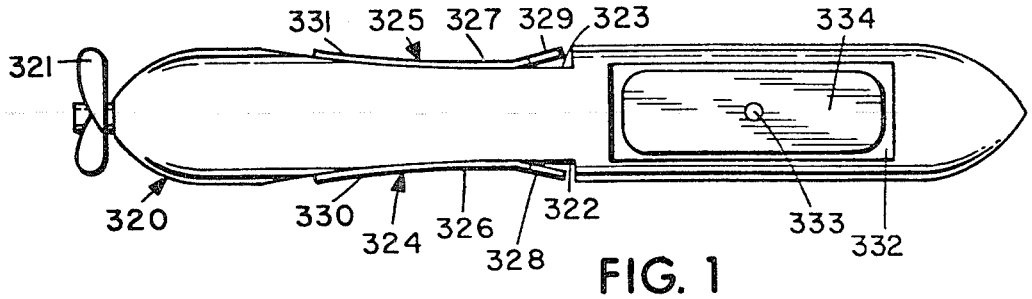
FIG. 1 is a top plan view of a torpedo employing vane members according to the present invention, as well as a hydrofoil, all disposed in their sheltered positions.

Referring now more particularly to the drawing, wherein like reference numerals designate identical parts throughout the several views, there is shown a torpedo, generally designated by the reference numeral 320; the body of torpedo 320 being generally cylindrical in form although including a rounded bow portion coming substantially to a point as well as a generally rounded stern portion from which a shaft carrying the propulsion screw 321 rearwardly extends.

Torpedo 320 is provided on opposite sides of the cylindrical portion of the body thereof with recesses 322, 323 formed therein, which commence at about the midships section thereof and extend rearwardly therefrom. A forward portion of each of such recesses 322, 323 includes a substantially planar, substantially operationally vertically extending surface having a longitudinal centerline substantially parallel to the longitudinal centerline of the torpedo 320. Each of such recesses 322, 323 includes a rearward portion of about twice the length of the forward portion thereof which gradually curves outwardly from the forward portion thereof towards the adjacent side of the body of torpedo 320.

Vane members, generally designated 324, 325, are mounted in recesses 322, 323, respectively. The vane members 324, 325 include substantially operationally vertically situated mounting sections 326, 327 which extend along the forward portions of the recesses 322, 323, respectively; forward short outwardly flared sections 328, 329, respectively; and rearward gradually curving long outwardly flared sections 330, 331, respectively.

The vane members 324, 325 are movably mounted on the torpedo 320 to rotate about an operationally substantially horizontally disposed axis situated adjacent the rearwardmost portions of the mounting sections 326, 327 thereof. A drive mechanism such as the drive mechanism 40 shown in FIG. 8 of the drawings of applicant's U.S. Pat. No. 4,040,373, issued Aug. 9, 1977, and fully structurally and functionally described in the specification thereof, may be effectively utilized to move the vane members 324, 325; the shafts 36 and 37 of such a drive mechanism 40 being connected to the vane members 324, 325, respectively.

Figure 2:
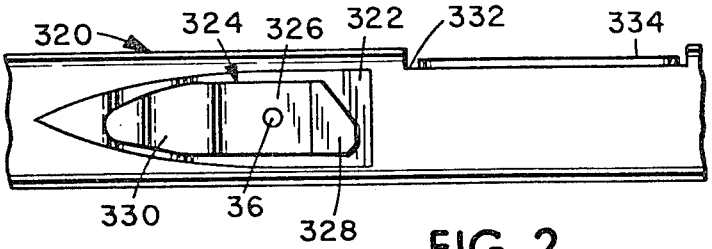
FIG. 2 is a partial side elevational view of the torpedo shown in FIG 1; and, FIG. 3 is another partial side elevational view of the torpedo shown in FIG. 1 with the vane members and hydrofoil in operating positions.

It is to be especially noted that the outward flare of the forward short sections 328, 329 and the rearward long sections 330, 331 of the vane members 324, 325, respectively, is very slight, and that when such vane members 324, 325 are disposed in their sheltered positions within the described recesses, with the longitudinal axes of such vane members 324, 325 substantially paralleling the longitudinal axis of torpedo 320, as shown in FIGS. 1 and 2, no portion of such vane members 324, 325 extends beyond the overall circular cross-sectional outline of such torpedo 320.

Torpedo 320 is further provided with another recess 332 formed in the top of the cylindrical portion of the body thereof forwardly of the recesses 322, 323 formed therein; such recess 332 including a substantially planar, substantially operationally horizontally extending surface having a longitudinal centerline substantially parallel to the longitudinal centerline of the torpedo 320. A rotatable shaft 333 extends upwardly from the interior of the body of the torpedo 320 centrally into such recess 332, and an elongated hydrofoil 334 which is substantially rectangular in planform is centrally connected to such shaft 333; the lower surface of such hydrofoil 334 lying substantially adjacent such surface of the recess 332. The hydrofoil 334 is so proportioned that when the same is in its sheltered position with its longitudinal centerline substantially parallel to the longitudinal centerline of the torpedo 320, no portion thereof extends beyond the overall circular cross-sectional outline of the body of the torpedo 320. Suitable conventional means are provided within the body of the torpedo 320 to rotate the shaft 333 carrying hydrofoil 334, and no further description thereof herein is deemed necessary.

Figure 3:
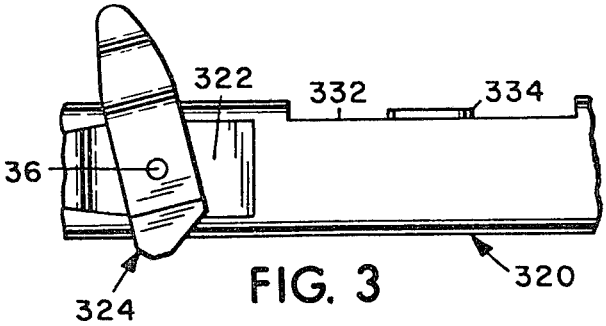

When the vane members 324, 325, as well as the hydrofoil 334, of torpedo 320 are in their sheltered positions, as hereinbefore set forth, the torpedo 320 may be placed in a tubular launcher carried by a marine vessel or an aircraft which has a cylindrical inner wall of the same diameter or slightly larger than the cylindrical outer wall of the body of such torpedo 320. When the torpedo 320 has been launched, conventional means may be utilized to actuate the drive mechanism 40 for the vane members 324, 325, and to also rotate the shaft 333, for extending such vane members 324, 325, as well as such hydrofoil 334, to their operating positions as shown in FIG. 3. In its operating position the hydrofoil 334, with its longitudinal axis extending at right angles to the longitudinal axis of the torpedo 320, provides sustentation for the torpedo 320, while the vane members 324, 325, with the long curvilinearly flared sections 330, 331 thereof projecting more or less operationally vertically upwardly, are operable to provide steering and heeling control for the torpedo 320. More particularly, it will be seen that when the vane members 324, 325 are counter-rotated while in their operating positions, the upper surface of either the flared section 330 of vane member 324 or the flared section 331 of vane member 325 will be exposed to the flowstream moving rearwardly alongside the body of torpedo 320 as the same moves forwardly through the water, while the lower surface of the corresponding flared section of the other of such vane members will be similarly exposed to such flowstream. The vane members 324, 325 thereby serve to steer the torpedo 320 to port or starboard and concurrently serve to properly heel or roll the torpedo 320 in the direction of turn. Such coordinated steering and heeling functions of the vane members 324, 325 facilitates stable turning maneuvers of the torpedo 320.

Further, the vane members 324, 325, while in their operating positions, are operable to provide pitch control for the torpedo 320. As illustrated in FIG. 3, both of such vane members 324, 325 have been concurrently rotated somewhat rearwardly to drive the torpedo 320 deeper into the water, and they may be similarly concurrently rotated forwardly to drive the torpedo 320 upwardly towards the surface of the water.

It will be noted that the forward short outwardly flared sections 328, 329 of vane members 324, 325, respectively, augment the effect of operational movements of the long outwardly flared sections 330, 331 of vane members 324, 325, respectively.

Obviously, other modifications and variations of the present invention are possible in the light of the foregoing teachings. It is therefore to be understood that within the scope of the appended claims the invention may be practiced otherwise than as specifically described.

I claim:

1. A torpedo operable submerged in water, comprising:

an elongated body;

a pair of elongated vane members positioned substantially alongside said body, each of said vane members having at least a long outwardly flared section operationally projecting away from said body and having an operationally substantially vertically situated mounting section operationally nearer said body than said outwardly flared section thereof;

mounting means mounting said mounting sections on said body for rotary movement about an operationally substantially horizontal common axis;

at least a portion of said long outwardly flared section of each of said vane members extending substantially in a plane which obliquely intersects said common axis, each of said vane members being rotatable about said common axis and thereby operationally movable into and out of alignment with the flowstream moving rearwardly alongside said body when said torpedo is moving forwardly through the water to concurrently serve steering and heeling functions;

said vane members remaining substantially completely submerged within the water while serving such steering and heeling functions.

2. The torpedo of claim 1, wherein said torpedo includes hydrofoil means providing sustentation for said torpedo.

3. The torpedo according to claim 1, wherein recesses are provided on opposite sides of said body, and wherein said mounting sections of said vane members are each mounted within one of said recesses, said vane members being rotatable between an operating position thereof and a sheltered position within said recesses wherein no portion of said vane members projects beyond the overall cross-sectional outline of said body.

4. The torpedo of claim 3, wherein said body is provided with a further recess, and wherein hydrofoil means occupy a sheltered position within said further recess with no portion thereof projecting beyond the overall cross-sectional outline of said body, said hydrofoil means being rotatably extendible from said sheltered position thereof to an operating position providing sustentation for said torpedo.

* * * * *